US006550826B2

(12) United States Patent
Fukushima et al.

(10) Patent No.: US 6,550,826 B2
(45) Date of Patent: Apr. 22, 2003

(54) DOOR LOCK APPARATUS

(75) Inventors: Yasuyuki Fukushima, Yokohama (JP); Noboru Takamura, Yokohama (JP); Shigenori Taga, Yokohama (JP); Jun Yamagishi, Yokohama (JP)

(73) Assignee: Ohi Seisakusho Co., Ltd. (JP)

( * ) Notice: Subject to any disclaimer, the term of this patent is extended or adjusted under 35 U.S.C. 154(b) by 45 days.

(21) Appl. No.: 09/746,126

(22) Filed: Dec. 22, 2000

(65) Prior Publication Data

US 2001/0005078 A1 Jun. 28, 2001

(30) Foreign Application Priority Data

Dec. 24, 1999 (JP) ..... 11-366078

(51) Int. Cl.[7] ..... E05C 3/06
(52) U.S. Cl. ..... 292/201; 292/216; 292/DIG. 23
(58) Field of Search ..... 292/201, 216, 292/DIG. 23

(56) References Cited

U.S. PATENT DOCUMENTS 4,219,227 A * 8/1980 Grabner et al. ..... 292/216
4,322,959 A * 4/1982 Mochida ..... 70/241
4,452,058 A * 6/1984 Noel ..... 70/137
4,518,181 A * 5/1985 Yamada ..... 292/201
4,664,430 A * 5/1987 Bernard ..... 292/201
4,762,348 A * 8/1988 Matsumoto ..... 292/201
4,861,089 A * 8/1989 Compeau et al. ..... 292/76
4,976,477 A * 12/1990 Nakao ..... 292/201
5,079,964 A * 1/1992 Hamada et al. ..... 74/89.15
5,238,274 A * 8/1993 Becker et al. ..... 292/201
5,240,296 A * 8/1993 Kobayashi ..... 292/201
5,564,308 A * 10/1996 Hoshikawa et al. ..... 74/89.14
5,634,677 A * 6/1997 Büschel et al. ..... 292/216
5,667,260 A * 9/1997 Weyerstall ..... 292/201
5,713,613 A * 2/1998 Honma et al. ..... 292/201
5,722,272 A * 3/1998 Bridgeman et al. ..... 70/264
5,765,884 A * 6/1998 Armbruster ..... 292/216
5,785,364 A * 7/1998 Kleefeldt et al. ..... 292/201
5,901,991 A * 5/1999 Hugel et al. ..... 292/201
6,048,002 A * 4/2000 Ohta et al. ..... 292/201
6,050,117 A * 4/2000 Weyerstall ..... 70/277
6,065,316 A * 5/2000 Sato et al. ..... 70/264
6,109,079 A * 8/2000 Ikeda ..... 70/264
6,349,983 B1 * 2/2002 Dupont et al. ..... 292/201
6,439,623 B1 * 8/2002 Lohfeld et al. ..... 292/201

* cited by examiner

*Primary Examiner*—James R. Brittain
*Assistant Examiner*—Carlos Lugo
(74) *Attorney, Agent, or Firm*—Kilpatrick Stockton LLP

(57) ABSTRACT

A door lock apparatus has a handle switch (31), which is placed in the on condition when an actuator member for opening and closing a back door is operated, an open switch (16), which is placed in the on condition when the door is closed to within a prescribed closure range, a drive circuit, which is formed so as to drive a door lock disengaging motor (25) when both the handle switch (31) and the open switch (16) are in the on condition, and a self-holding circuit holding a condition in which the drive circuit is formed and, in response to the open switch going into to off condition, releasing the condition in which the drive circuit is formed.

10 Claims, 6 Drawing Sheets

DOOR LOCK APPARATUS

BACKGROUND OF THE INVENTION

1. Field of the Invention

The present invention relates to a door lock apparatus suitable for use in a door lock of a vehicle.

2. Related Art

In the past, a door lock apparatus used in a door lock of a vehicle had a handle mounted on the inside or the outside of a back door for opening and closing thereof, an opener handle provided in proximity to the driver's seat, and an operating member such as a key plate of a key cylinder, so that the initial stage of the opening operation causes the unlocking of the back door lock. More specifically, when the back door in the closed condition is to be opened by a door lock apparatus, first the initial opening operation of the operating member is performed, whereupon the door lock apparatus changes the back door from fully locked condition to the half-locked condition, and then to the open condition, in which the back door lock is disengaged. After that, the back door can be opened by hand.

With a decrease in seal repulsive force caused by back door vertical mounting and the like, a stopped condition on a steep downgrade, and an increase in pull-in force by a gas-loaded stay, when an operator removes his or her hand from the operating member at the initial opening operation of the operating member, the back door can return to the closed condition.

If this condition occurs, with a back door lock apparatus of the past there is return again to either the half-latched condition or the fully latched condition. For this reason, it is necessary to repeat the opening operation from the initial opening operation stage using the operating member, this representing an extremely troublesome reduction in ease of operation.

Accordingly, it is an object of the present invention to provide a door lock apparatus making use of the drive force of a motor that disengages a door lock, thereby lightening the burden on the operator and greatly improving the ease of operation.

SUMMARY OF THE INVENTION

A door lock apparatus according to the present invention comprises a lock mechanism enabling locking and unlocking of a door, a lock disengaging mechanism which when driven by a motor causes a door lock to be unlocked by the lock mechanism, a first detector detecting that an actuator member for opening and closing the door has been operated, a second detector detecting that the door has been closed to within a prescribed range of closure, and a controller which during a time when the second detector is detecting causes continuous drive of the motor and which stops driving of the motor when the second detector is not detecting.

BRIEF DESCRIPTION OF THE DRAWINGS

The above and other features will be better understood from the exemplary embodiments described below, taken together with the drawings, of which.

DETAILED DESCRIPTION OF THE PREFERRED EMBODIMENT

A preferred embodiment of the present invention are described in detail below, with references made to relevant accompanying drawings. In the embodiment described, the present invention is applied as a door lock mechanism for the back door of a vehicle.

Figure 1:
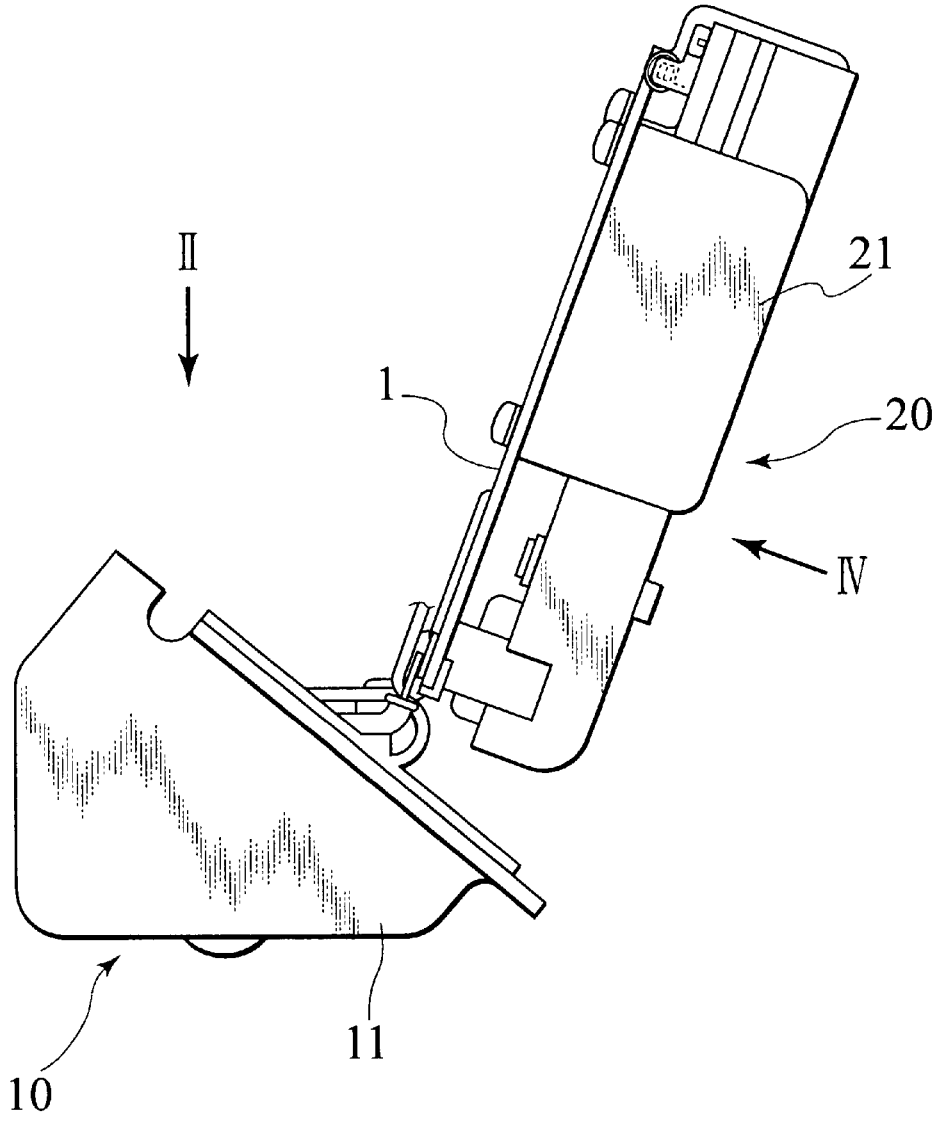
FIG. 1 is a side elevation showing a door lock apparatus according to the present invention.

In FIG. 1, which shows an embodiment of the present invention, the reference numeral 1 denotes a base plate mounted to a fixed location on a back door. In FIG. 1, the base plate 1 appears to be substantially bent in a V-shape when viewed from the side, a lock mechanism 10 within a case 11 being mounted to one end thereof, and a lock disengaging mechanism 20 within a case 21 being mounted to another end thereof. The lock mechanism 10 can lock and unlock a striker S (refer to FIG. 2 and FIG. 3) mounted at a fixed location on the body of the vehicle, and the lock disengaging mechanism 20 can disengage the lock mechanism 10. The individual configurations of the mechanisms 10 and 20 are described below.

Figure 2:
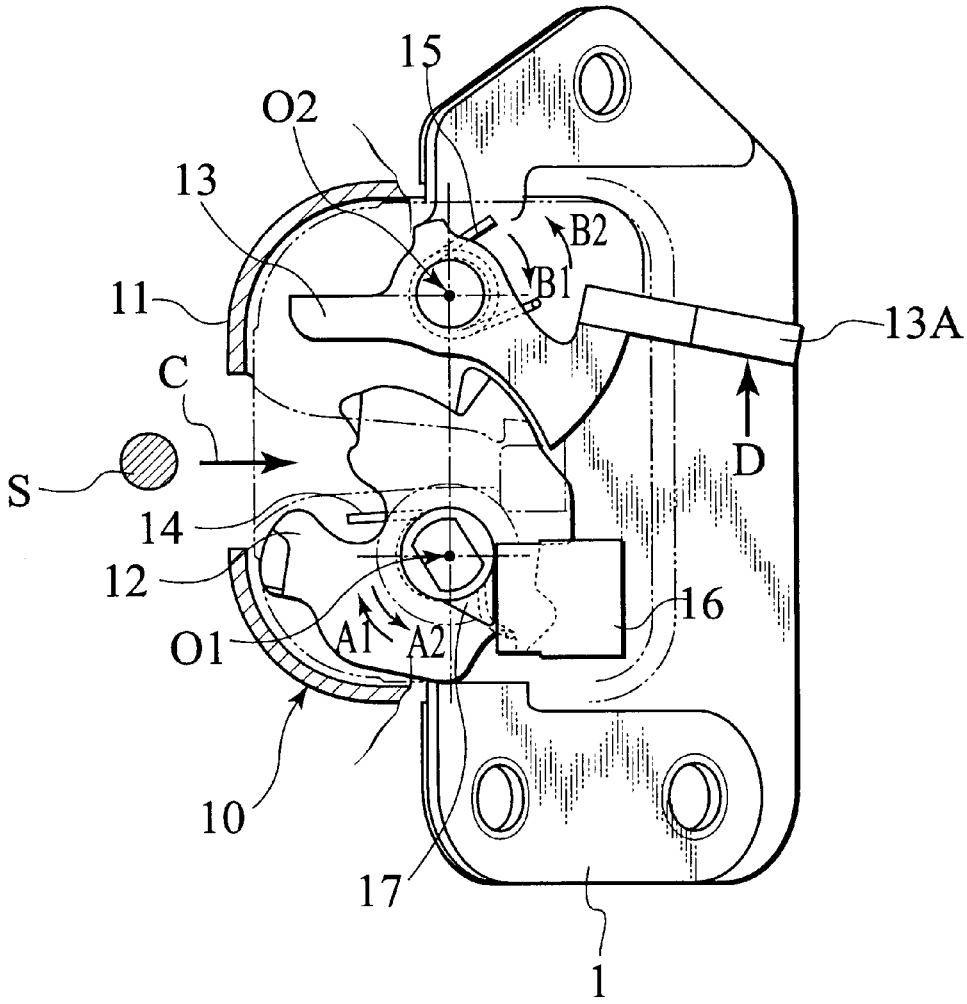
FIG. 2 is a partially cutaway front elevation showing the door lock apparatus of FIG. 1 viewed from the direction of the arrow II in FIG. 1.
Figure 3:
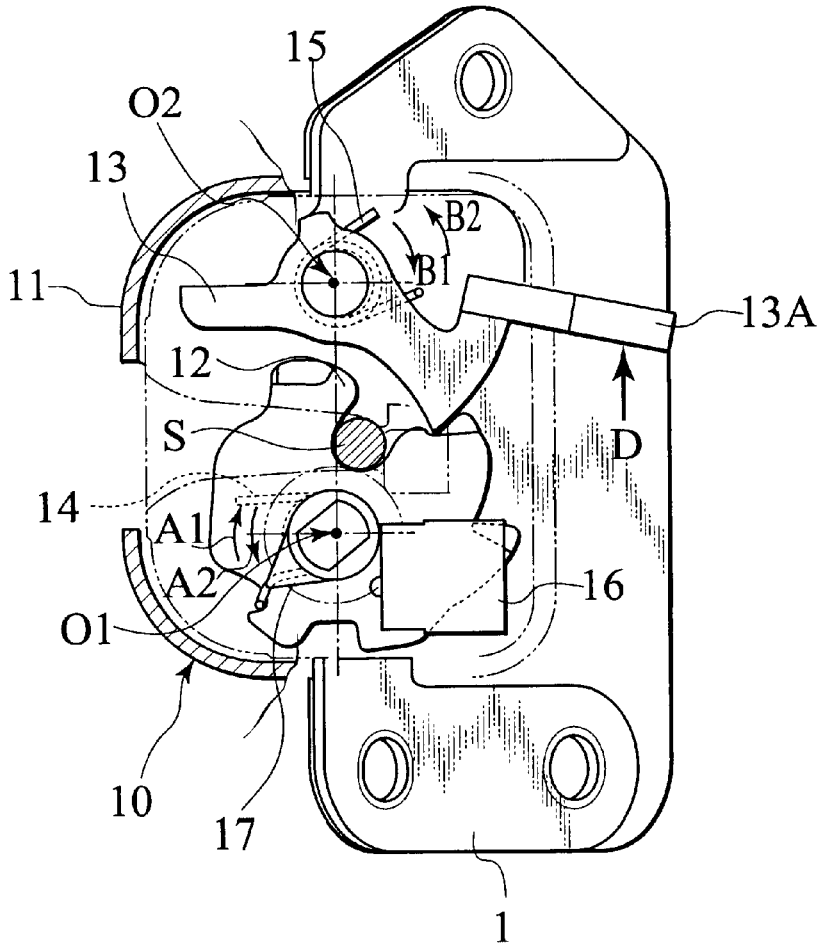
FIG. 3 is a partially cutaway front elevation showing the door lock apparatus of FIG. 2 in a different operating condition.

As shown in FIG. 2 and FIG. 3, lock mechanism 10, similar to a conventional door lock mechanism, has a latch plate 12 swingable in the directions of arrows A1 and A2 about an axis O1 as a center, a locking plate 13 swingable in the directions B1 and B2 about an axis O2 as a center, a spring 14 impelling the latch plate 12 in the direction of arrow A2, and a spring 15 impelling the locking plate 13 in the direction of the arrow B1. In the condition shown in FIG. 2, the lock mechanism 10 is in the open condition, in which the striker S is unlocked. With the back door closed, the striker S on the vehicle body advances relatively toward the inside of the lock mechanism 10 from the direction of the arrow C. After the latch plate 12 passes the half-latched position, it swings as far as the fully latched position shown in FIG. 3, so that the lock mechanism 10 is placed in the fully latched condition. Thus, in the fully latched condition the locking plate 13 prevents the return of the latch plate 12 in the direction of the arrow A2, so that the back door is locked in the closed condition.

When the back door is to be unlocked, the lock disengaging mechanism 20, described further below, presses an actuator part 13A of the locking plate 13 in the direction of the arrow D. This action causes the locking plate 13 to swing in the direction of the arrow B2, thereby releasing the restriction on the latch plate 12 moving in the direction of the arrow A2, so that the latch plate swings in the direction of the arrow A2, so as to unlock the striker S.

The reference numeral 16 denotes a normally closed open switch (second detection means), which is opened and closed by the switch lever 17, which swings in concert with the latch plate 12. That is, with the lock mechanism 10 in the open condition as shown in FIG. 2, the switch lever 17 presses the open switch 16, so that the associated switch lever 17 is placed in the off (open) position. By the latch plate 12 swinging in the direction of the arrow A1 from the open condition of FIG. 2, the switch lever 17 is moved away from the open switch 16, so that the open switch 16 is placed in the on (closed) condition. Thus, the open switch 16 is only off when the lock mechanism 10 is in the open condition, and is on in both the half-latched condition and the fully latched condition. The open switch 16 serves as detection means for detecting that the back door has been closed to within a prescribed range of closure.

Figure 4:
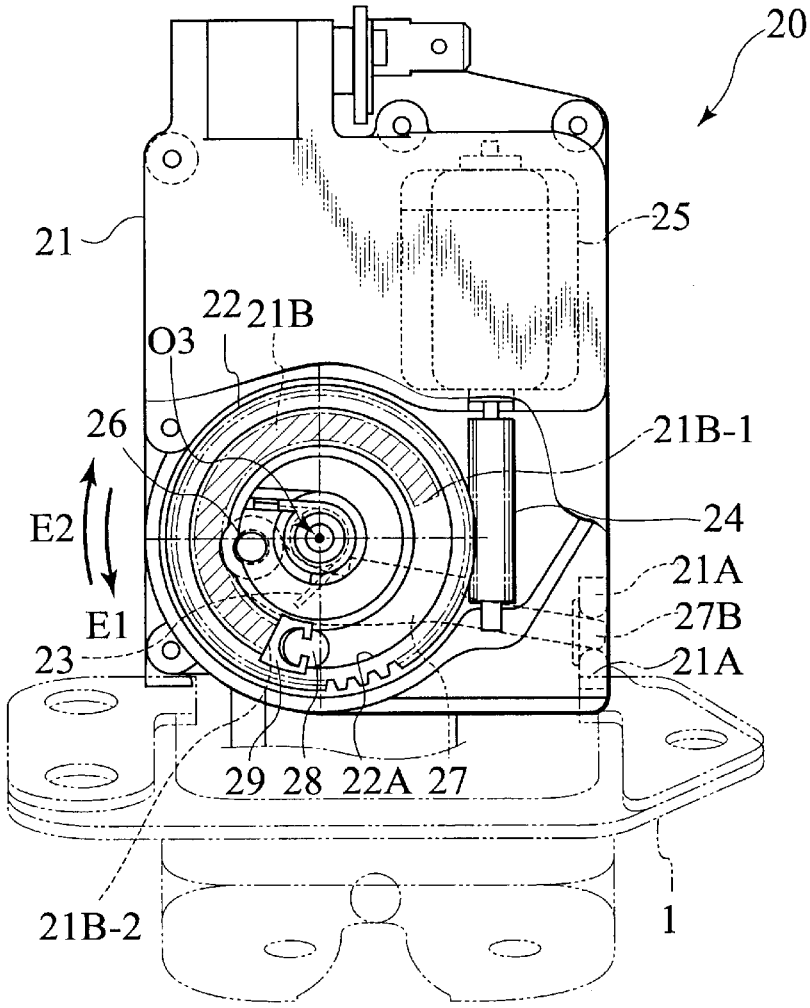
FIG. 4 is a partially cutaway front elevation showing the door lock apparatus of FIG. 1, viewed from the direction of the arrow IV.
Figure 5:
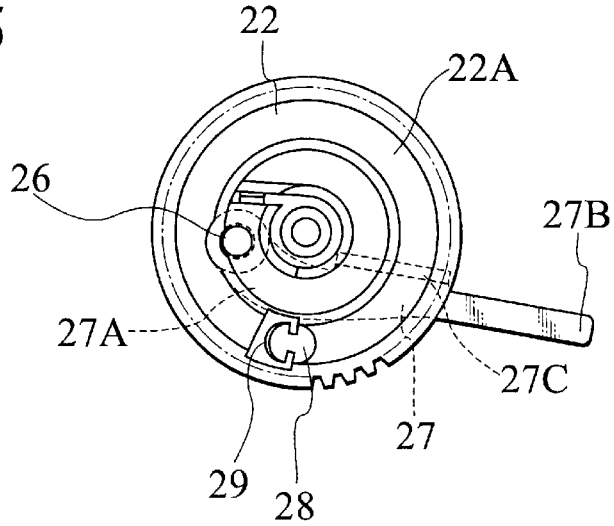
FIG. 5 is a front elevation showing the worm wheel part of FIG. 4.

The lock disengaging mechanism 20, as shown in FIG. 4, has a worm wheel 22 swingable in the directions of the arrows E1 and E2 about an axis 03. The worm wheel (sometimes referred to herein as simply a wheel) 22 is impelled in the direction of the arrow E2 by the spring 23, and is linked to an electrical motor 25 via a worm 24. As shown in FIG. 5, a lever 27 is swingably linked by a shaft 26 connecting an end part 27A of the lever at a fixed position on the rear side of the wheel 22, the end part 27B of the lever being guided within guide parts 21A, 21A of the case 21. When the drive from the motor 25 causes the wheel 22 to swing in the direction of the arrow E1, the lever 27 moves in the direction of the arrow E1, as shown by the double-dot-dashed line in FIG. 6, and when the drive from the motor 25 is stopped, the impelling force of the spring 23 causes the return by swinging in the reverse direction of the arrow F2, indicated by the double-dot-dashed line as shown in FIG. 6, a curved operating part 27C opposing an actuator part 13A of the Locking plate 13 in this lock mechanism 10 is formed at a center part of the lever 27, so that when the lever 27 moves in the direction of the arrow F1, this operating part 27C causes the actuator part 13A of the locking plate 13 to move in the direction of the arrow D.

As shown in FIG. 5, a stopper 29 with a shock-absorbing material 28 made of a material such as rubber is mounted within an annular groove 22A on the front side of the wheel 22 and, as shown in FIG. 4, a protrusion 21B that is substantially C-shaped when viewed in plan-view fashion is formed at a location within the annular groove 22A. The limit of the swing of the wheel 22 in the direction of the arrow E1 is established by the shock-absorbing material 28 coming into contact with one end 21B-1 of the protrusion 21B, and the limit of the swing of the wheel 22 in the direction of the arrow E2 is established by the stopper 29 coming into contact with the other end 21B-2 of the protrusion 21B.

Figure 6:
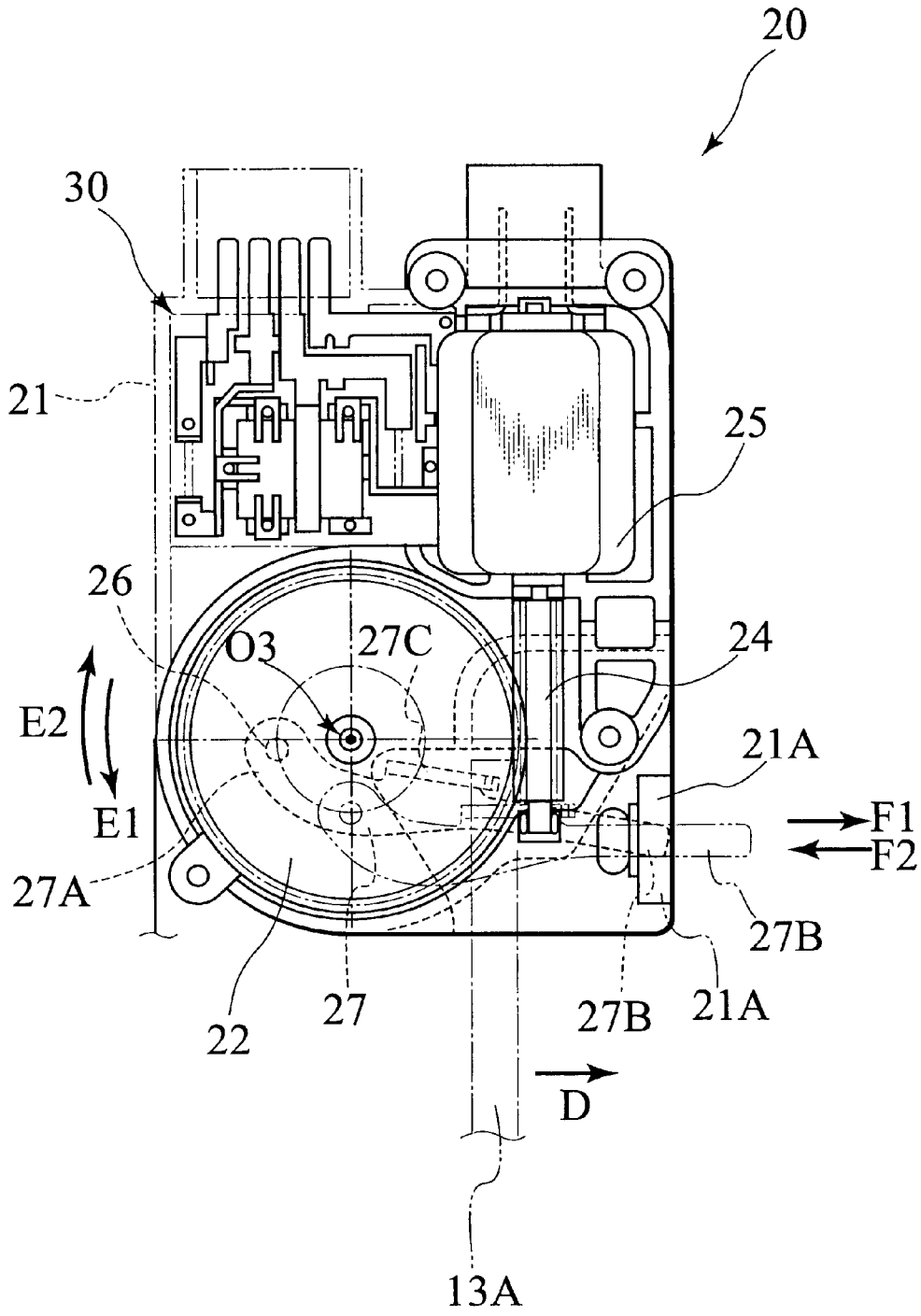
FIG. 6 is a front elevation illustrating the operation of the lock disengaging mechanism of FIG. 4.
Figure 7:
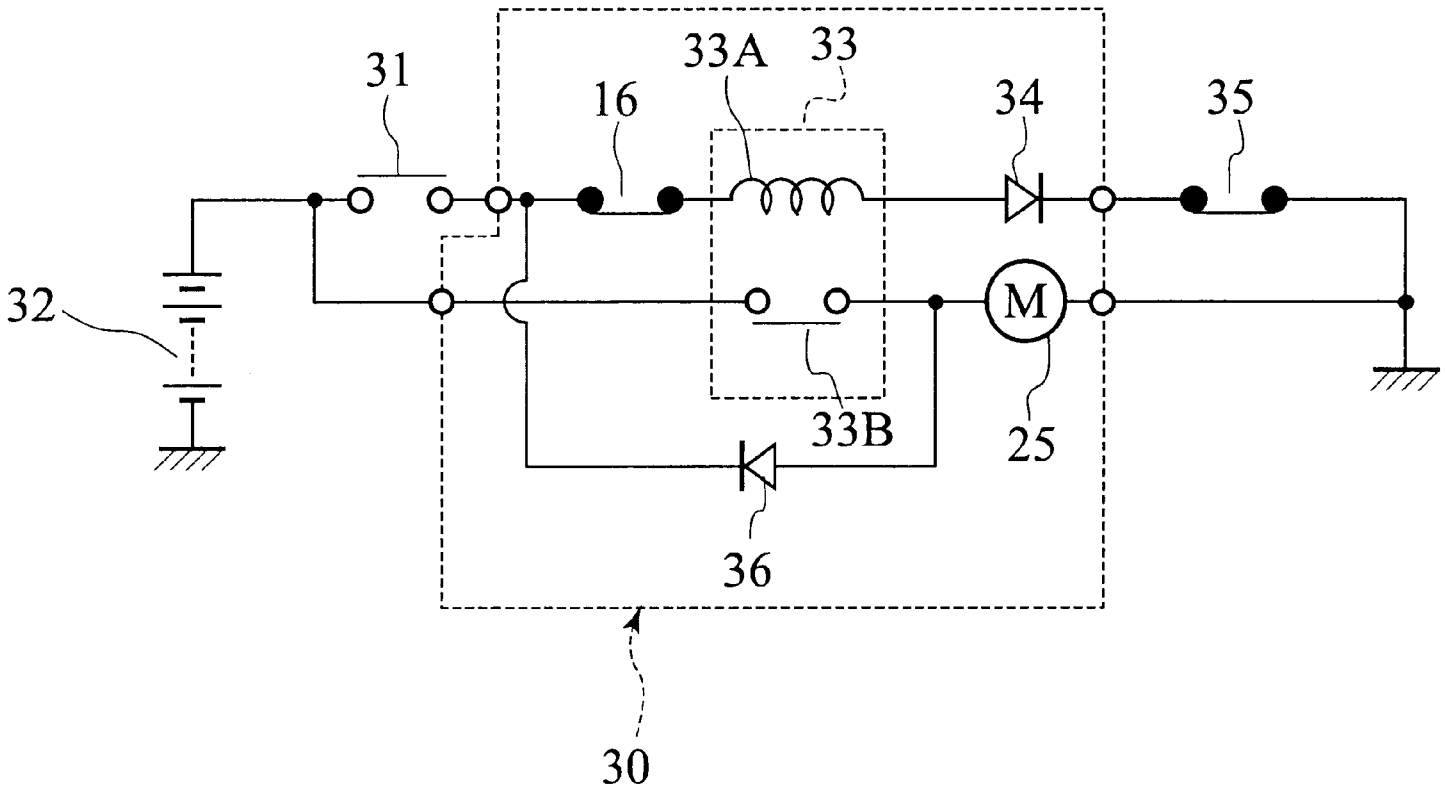
FIG. 7 is a circuit diagram showing the controller of FIG. 6.

As shown in FIG. 6, a controller (control means) 30 for the motor 25 is also housed within the case 21. The controller 30, as shown in FIG. 7, has a circuit configuration that includes the open switch of the lock mechanism 10.

That is, one end of the open switch is connected via a handle switch 31 to a power supply 32 of the vehicle, and the other end of the open switch 16 is grounded via a relay coil 33A of a relay 33, a diode 34, and a switch 35, which is opened and closed by a externally applied control signal. The handle switch 31 is a normally closed switch which is set to on (closed) by the action of an actuating member of a handle for opening and closing the back door mounted on the inside or outside of the back door, or of a key plate of a key cylinder. The switch 35 is a normally closed switch that is switched off (opened) by a door lock disengaging inhibit signal from a central door lock controller, for example, so that it is settable to off only when the door lock disengaging is inhibited. One input terminal of the motor 25 is connected to the vehicle power supply 32 via a relay contact (normally open contact) 33B of the relay 33, and also connected, via a diode 36, to the connection node between the open switch 16 and the handle switch 31. The other input terminal of the motor 25 is grounded.

The actions of the door lock mechanism of the present invention when the door is closed and when the door is opened are described separately below.

When the door is closed, it causes the lock mechanism 10 as described above to move from the opened condition to the half-latched condition, and then to the fully latched condition shown in FIG. 3, thereby locking the back door in the closed condition.

When door is opened from the fully latched condition of the lock mechanism 10, because the open switch 16 is in the on condition, in the case in which the back door is opened by an operating member, the handle switch 31 is placed in the on condition, thereby causing the relay 33 to operate. The effect of this that the relay contact 33B is switched to on (closed), thereby forming a drive circuit for the motor 25, the drive force of which causes the wheel 22 to swing in the direction of the arrow E1, so that the lever 27 moves in the direction F1 indicated by the double-dot-dashed line in FIG. 6. The operating part 27C of the lever 27 presses the actuator part 13A of the locking plate 13 in the direction of the arrow D, causing the locking plate 13 to swing in the direction of the arrow B2 in FIG. 3. As a result, the back door can be opened by continuing the opening operation.

In the initial stage of the operation of opening the back door, in the time during which the lock mechanism 10 is in the open condition, such as shown in FIG. 2, the open switch 16 is on (closed). During the time in which the open switch 16 is on, even if the handle switch 31 should be in the off condition, the self-holding circuit that includes the relay contact 33B and the diode 36 form a closed circuit for the relay coil 33A, so as to continue the formation of the drive circuit of the motor 25. For this reason, at the initial stage of the opening operation, in which the open switch 16 is on, even if the hand is removed from an actuator part such as a handle for opening and closing the back door, so that the handle switch 31 is set into the off condition, the locking plate 13 is held by the continuously applied drive force of the motor 25 in the swing position in the direction of the arrow B2 in FIG. 2. The lock mechanism 10, therefore, does not go into the half-latched or fully latched condition, and can thereafter be further opened by hand.

After the initial stage of the operation of opening the back door has been achieved, because the open switch 16 goes into the off (opened) condition, the circuit powering the relay coil 33A is broken, so that the relay contact 33B is switched of, thereby cutting off the drive circuit for the motor 25. For this reason, the impelling force of the spring 23 causes the wheel 22 to swing in the direction of the arrow E2, and the lever 27 moves so as to return in the direction of the arrow F2 as shown by the double-dot-dashed line of FIG. 6, resulting in the locking plate 13 swinging in return in the direction of the arrow B1 shown in FIG. 2.

After the operation of opening the back door passes the initial stage and proceeds to the point at which the open switch 16 is set to off, even if the handle switch should be placed in the on condition, the relay 33 is not operated, so that the motor 25 drive circuit is not formed. Thus, it is possible to avoid unnecessary operation of the lock disengaging mechanism 20.

When the lock mechanism 10 is in the fully latched condition, if a door lock disengaging inhibit signal, for example from a central processor, is used to place the switch 35 in the off (open) condition, the circuit powering the relay coil 33A is broken, thereby preventing the door lock from being disengaged.

As described in detail above, in a door lock mechanism according to the present invention, during the period of time in which the door is closed within a prescribed range of closure, the door lock disengaging motor is continuously driven from the time an actuating member for opening and closing the door is operated, and when the door is outside the prescribed range of closure, the motor drive is stopped, thereby stopping the operation of disengaging the actuator member at the initial stage of the door opening operating, so as to prevent relocking of the door even if the hand is removed. Additionally, it is possible to prevent unnecessary motor drive when the door is opened so that is it outside the prescribed range of closure and, as a result, it is possible to use the drive of the door lock disengaging motor to lower the burden on the operator and greatly improve the ease of operation.

The lock mechanism of the present invention has a mechanism wherein movement in concert of the latch plate and the locking plate locks the door and wherein the drive power of the door lock disengaging motor is used to disengage the door lock, the handle switch and open switch being used to operate and actuator member, and the closure of the door to within a prescribed closure range is detected, the results of that detection being used as the basis for control of the drive circuit of the door lock disengaging motor and the holding circuit of the drive circuit, thereby ensuring appropriate and reliable motor control.

By providing a switch that inhibits the formation of a drive circuit for the door lock disengaging motor, based on an externally applied control signal, it is possible, in response to a control signal from a central door lock controller or the like, to inhibit the disengagement of the door lock.

While a preferred embodiment of the present invention has been described using specific terms, such description is for illustrative purposes, and it is to be understood that changes and variations may be made without departing from the spirit or scope of the following claims.

What is claimed is:

1. A door closure apparatus comprising:

a door locker selectably operative to engage and disengage a striker and shiftable from a locking state thereof to an unlocked state thereof;

a shifter operatively associated with the door locker and operative to effect a shift of the door locker from the locking state to the unlocked state; and a prohibitor operatively associated with the shifter to prohibit a reversal of the shifter and comprising a supply maintaining element selectably operative to maintain a supply of power to a drive of the shifter, and a supply interrupter operative to detect a completion of the shift of the door locker to interrupt the supply of power to the drive;

the door locker comprising:

a latch mechanism;

a first tendency provider operative to provide the latch mechanism with a first tendency to unlatch; and a tendency restricter selectably operative to provide a restriction to the first tendency, whereby the door closure apparatus is operative to have the locking state with the latch mechanism in a latching state, and to have the unlocked state with the latch mechanism in an unlatched state;

the shifter comprising a mechanical element operative to interrupt the restriction of the first tendency, in a first position thereof;

the drive being operative to drive the mechanical element to the first position; and the prohibitor being operative to prohibit a stop after startup of the drive; and the drive comprises: a motor;

a first circuit operative to supply electric power to the motor;

a first switch installed in the first circuit;

an actuator operative to actuate the first switch; and a second circuit operative to supply electric power to the actuator; and the supply maintaining element comprising a diode circuit interconnecting a ground end of a node of the first circuit and a power supply end of the actuator of the second circuit, so that the second circuit maintains power to the motor if the first switch interrupts the first circuit.

2. A door closure apparatus according to claim 1, wherein the supply interrupter comprises:

a detecting element operative to detect the latching state and the unlatched of the latch mechanism; and a second switch installed in the second circuit and operative to close as the detecting element detects the latching state, and operative to open as the detecting element detects the unlatched state, thereby interrupting the supply of power to the motor through the supply maintaining circuit.

3. A door closure apparatus according to claim 2, wherein the second circuit comprises a third switch to be manually operative.

4. A door closure apparatus according to claim 3, wherein the second circuit comprises a fourth switch to be externally controllable.

5. A door closure apparatus comprising:

a door locker selectably operative to engage and disengage a striker and shiftable from a locking state thereof to an unlocked state thereof;

a shifter operatively associated with the door locker and operative to effect a shift of the door locker from the locking state to the unlocked state; and a prohibitor operatively associated with the shifter to prohibit a reversal of the shifter and comprising a supply maintaining element selectably operative to maintain a supply of power to a drive of the shifter, and a supply interrupter operative to detect a completion of the shift of the door locker to interrupt the supply of power to the drive;

the door locker comprising:

a latch mechanism;

a first tendency provider operative to provide the latch mechanism with a first tendency to unlatch; and a tendency restricter selectably operative to provide a restriction to the first tendency, whereby the door closure apparatus is operative to have the locking state with the latch mechanism in a latching state, and to have the unlocked state with the latch mechanism in an unlatched state;

the shifter comprising a mechanical element operative to allow the restriction of the first tendency, in a second position thereof; and the shifter comprising a second tendency provider operative to provide the mechanical element with a second tendency to have the second position.

6. A door closure apparatus according to claim 5, wherein the second tendency provider comprises:

a rotary member operative to swingably pivot the mechanical element;

a bias member operative to bias the rotary member in a prescribed rotational direction; and a movement restricter operative to restrict movement of a swinging end of the mechanical element, to displacement relative to the tendency restricter.

7. A door closure apparatus according to claim 6, wherein the second tendency provider comprises a rotation restricter operative to restrict rotation of the rotary member.

8. A door closure apparatus according to claim 7, wherein the rotation restricter comprises:

a stopper provided on the rotary member; and a protrusion provided on a support member supporting the rotary member and configured to be engageable at an end thereof with the stopper.

9. A door closure apparatus according to claim 8, wherein the rotation restricter comprises a buffer provided on the rotary member and operative to be engageable with another end of the protrusion.

10. A door closure apparatus according to claim 6, wherein the drive comprises:

a driven gear (24) meshed with the rotary member; and a motor (25) operative to drive the driven gear.

* * * * *